US005471777A

United States Patent [19]

McDonald

[11] Patent Number: 5,471,777

[45] Date of Patent: Dec. 5, 1995

[54] FIREARM SIGHTING DEVICE

[76] Inventor: Kenneth E. McDonald, 627 Chisholm Trail, Waxahachie, Tex. 75165

[21] Appl. No.: 154,258

[22] Filed: Nov. 18, 1993

[51] Int. Cl.[6] ..... F41G 1/36

[52] U.S. Cl. ..... 42/103; 33/241; 362/110

[58] Field of Search ..... 33/241; 42/100, 42/102, 103; 362/110, 113, 114

[56] References Cited

U.S. PATENT DOCUMENTS

| | | | |
|---|---|---|---|
| 3,833,799 | 9/1974 | Audet | 33/241 |
| 3,914,873 | 10/1975 | Elliott et al. | 33/241 |
| 3,974,585 | 8/1976 | Dunham | 33/241 |
| 3,974,586 | 8/1976 | Kappner | 33/233 |
| 3,994,072 | 11/1976 | Agnello, Jr. | 33/241 |
| 4,220,983 | 9/1980 | Schroeder | 362/114 |
| 4,401,166 | 8/1983 | Brown | 172/430 |
| 4,417,814 | 11/1983 | Doliber | 356/252 |
| 4,434,560 | 3/1984 | Comeyne | 33/241 |
| 4,494,820 | 1/1985 | Klawitter | 350/4.1 |
| 4,511,005 | 4/1985 | Brown | 33/264 |
| 4,677,782 | 7/1987 | Gordon et al. | 42/100 |
| 4,713,889 | 12/1987 | Santiago | 33/241 |
| 4,761,196 | 8/1988 | Brown et al. | 156/247 |
| 4,993,833 | 2/1991 | Lovey et al. | 356/252 |
| 5,050,982 | 9/1991 | Meissner | 351/203 |
| 5,052,794 | 10/1991 | Brown et al. | 351/162 |
| 5,056,909 | 10/1991 | Brown et al. | 351/177 |
| 5,090,805 | 2/1992 | Stawarz | 356/251 |
| 5,146,686 | 9/1992 | Brown | 33/264 |
| 5,173,721 | 12/1992 | Green | 2/423 |
| 5,189,555 | 2/1993 | Jorlov | 359/618 |
| 5,201,122 | 4/1993 | Annunziata | 33/241 |
| 5,279,061 | 1/1994 | Betz et al. | 42/103 |

FOREIGN PATENT DOCUMENTS

| | | | |
|---|---|---|---|
| 502563 | 10/1956 | Italy | 42/103 |

*Primary Examiner*—Stephen M. Johnson
*Attorney, Agent, or Firm*—L. Dan. Tucker

[57] ABSTRACT

A firearm sighting device is disclosed that prevents dominant eye crossover and ensures proper shoulder placement of the firearm for increased accuracy. The sighting device includes an elongated housing having an opening at one end, and a light source is disposed in the housing oppositely from the open end. The housing is adapted to be mounted on the barrel of a firearm with the opening directed toward the butt end portion of the firearm and with the light source near the muzzle end. The housing has a diameter and length sufficient to prevent the shooter's non-aiming eye from seeing the light source, so dominant eye crossover is prevented. The diameter of the housing also prevents the shooter's aiming eye from seeing the light source unless the aiming eye is properly aligned with the barrel, so the sighting device ensures that the firearm has been properly shouldered.

14 Claims, 1 Drawing Sheet

FIREARM SIGHTING DEVICE

FIELD OF THE INVENTION

The present invention relates to a firearm sighting device, and more particularly to an illuminated sighting device that improves aiming accuracy by preventing dominant eye crossover and ensuring proper shoulder placement of the firearm.

BACKGROUND OF THE INVENTION

Firearms are usually aimed by a shooter using one eye to align the front and rear sights with a target. However, when aiming at fast moving targets such as flying game birds, the shooter may not have enough time to align front and rear sights. Consequently, some firearms, and more particularly shotguns, have only a front sighting bead on the muzzle end of the barrel allowing the shooter to aim the firearm by pointing the barrel, instead of aligning front and rear sights. Shooters must avoid two problems when aiming a firearm having only a front sighting bead. First, the shooter must not use his non-aiming eye to align the front sighting bead with the target. Second, because the firearm lacks a rear sight to align with the front sighting bead, the shooter's aiming eye must be aligned with the barrel to view the sighting bead in a path substantially parallel to the barrel.

Most people have one eye that is more dominant than the other. Right handed people normally have a dominant fight eye, and left handed people normally have a dominant left eye. Some shooters, however, must shoulder their firearm oppositely from their dominant eye, so they aim with their weaker eye. This usually occurs when left handed shooters use firearms intended for fight handed people or when fight handed shooters have a dominant left eye. Because most shooters prefer to keep their non-aiming eye open to view the target, these shooters usually have a tendency to use their dominant, non-aiming eye to align the sighting bead or the end of the barrel with the target. This problem is known as dominant eye crossover.

Improper shoulder placement of the firearm is also a common problem encountered by shooters aiming a firearm having only a from sighting bead. If the butt end of the firearm is improperly shouldered, the shooter's aiming eye will not be aligned with the barrel, and the alignment of the shooter's aiming eye and the front sighting bead will not correspond to the actual firing line of the firearm. Novice shooters and those shouldering their firearm oppositely from their dominant eye are likely to not even realize their mistake since the sighting bead remains visible even when the firearm is improperly shouldered.

Several prior art devices have attempted to overcome the problems associated with dominant eye crossover. For example, U.S. Pat. No. 3,974,586 to Kappner discloses a blinder, in the form of a thin strip, which extends rearwardly and to one side of the front sighting bead to block it from view of the non-sighting eye. The shooter's accuracy can still be reduced if his dominant eye is used to align the end of the barrel with the target. Moreover, the '586 device does not prevent improper shouldering of the firearm.

U.S. Pat. No. 5,056,909 to Brown et at. and U.S. Pat. No. 5,052,794 to Brown et at. disclose contact lenses having a central region to cover the pupil of the dominant eye to sufficiently blur the image normally seen by the dominant eye. Dominant eye crossover is eliminated, but the shooter's non-aiming eye cannot be used to view the target because his vision is blurred.

U.S. Pat. No. 4,761,196 to Brown et at. discloses a thin flexible disk that can be placed on the optical lenses of the shooter's glasses to partially block the view of the shooter's dominant eye. The view of the sighting bead is blocked, so dominant eye crossover is eliminated. However, the device obstructs the view of the shooter's non-aiming U.S. Pat. No. 4,695,159 to Cannon discloses a sight for a firearm in which the shooter looks into the sight with his dominant eye while viewing the whole of the target area with the other eye. A light spot produced by the sighting device will appear to the observer to be superimposed on the target.

SUMMARY OF THE INVENTION

The present invention relates to a firearm sighting device that improves aiming accuracy by eliminating dominant eye crossover and by requiring proper shoulder placement of the firearm. The device does not restrict the shooter's view, and the shooter can keep both eyes open to determine the distance and speed of moving targets.

The sighting device includes a tubular shaped housing member that can be mounted on the top of the firearm barrel in a substantially parallel manner. One end of the housing is relatively close to the muzzle end of the firearm, and the other end is substantially open. A light source is disposed within the housing member, away from the open end. Thus, the shooter's aiming eye can look down a path substantially parallel with the barrel to see the light source within the housing member through the open end.

The length and diameter of the housing prevent the shooter's non-aiming eye from seeing the light source, and the visual stimulus of the light source overcomes the shooter's tendency to use his non-aiming, dominant eye to align the end of the barrel with the target. Thus, dominant eye crossover is prevented. In addition, the diameter of the housing member prevents the shooter's aiming eye from seeing the light source if shooter's aiming eye is not properly aligned with the barrel. Thus, the shooter must properly shoulder the firearm to see the light source.

The sighting device is preferably about 6 inches long with a diameter of about 0.125 inches, so the sighting device is not much larger than the front sighting bead when viewed with the aiming eye. The light source is preferably an liquid crystal display (LCD) or a light emitting diode (LED), and a switch allows the shooter to energize the light source as desired. Mounting brackets secure the sighting device to the top side of the barrel, but the brackets preferably allow the sighting device to be readily removed by the shooter.

DETAILED DESCRIPTION OF THE DRAWINGS

Figures 1, 2, 3:
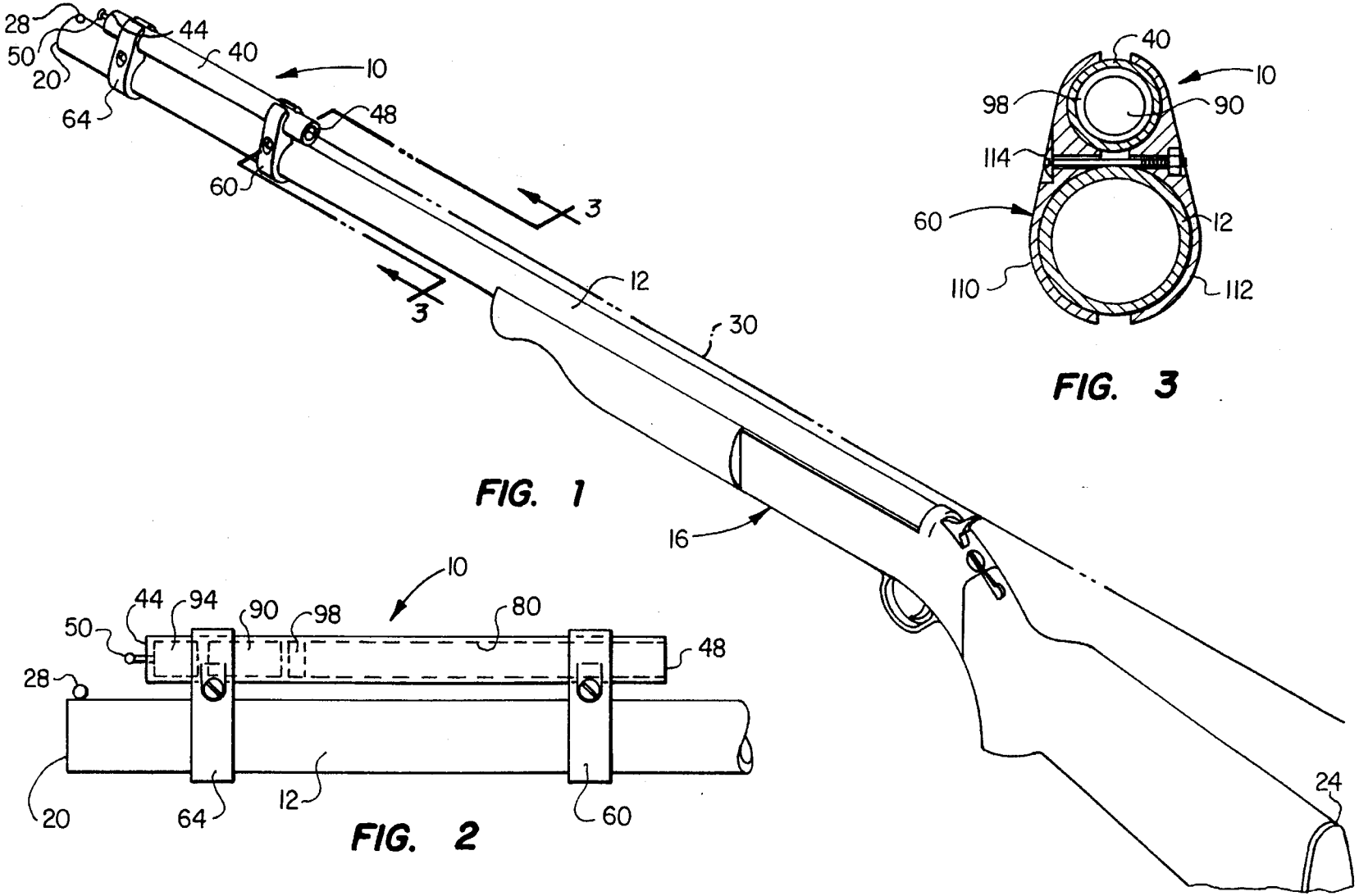
FIG. 1 is a perspective view of a sighting device constructed in accordance with the present invention and mounted on a firearm.
FIG. 2 is an enlarged side view of the sighting device as shown in FIG. 1.
FIG. 3 is a sectional view of the sighting device and gun barrel shown in FIG. 1 taken along line 3—3.

FIG. 1 is a perspective view of sighting device 10 mounted on barrel 12 of firearm 16 which is a standard shotgun having muzzle end 20 and butt end 24. Firearm 16 has front sighting bead 28 extending from barrel 12 near muzzle end 20, but firearm 16 does not have a rear sight.

Thus, a shooter must align his aiming eye with barrel 12 along line 30 to ensure proper aim of firearm 16.

Sighting device 10 includes elongated housing member 40 having front portion 44 and a substantially open rear portion 48. Brackets 60 and 64 attach elongated housing member 40 to barrel 12 with rear portion 48 directed toward butt end 24 of firearm 16. The axis of housing member 40 coincides with line 30 so that a shooter's aiming eye can see into housing member 40 through rear portion 48. Switch 50 extends from front portion 44 of housing member 40.

FIG. 2 is an expanded side view of sighting device 10. Elongated housing member 40 is substantially hollow having inner wall 80. Light source 90 is contained within housing member 40 near the front portion 44, and power source 94 is disposed between light source 90 and front portion 44 of housing member 40. Power source 94 is electrically coupled with light source 90, and switch 50 is disposed between light source 90 and power source 94 in the ordinary manner. Polarizing filter 98 is disposed between light source 90 and rear portion 48 to reduce the amount of light reflected by inner wall 80. Housing member 40 is mounted on the top portion of barrel 12, with front portion 44 in close relation with sighting bead 28 near muzzle end 20 of firearm 16.

FIG. 3 is cross sectional view of sighting device 10 and firearm 16 taken along line 3—3 of FIG. 1. Mounting bracket 60 includes oppositely disposed clamping members 110 and 112 which are held together with fastening means 114. Mounting bracket 64 is substantially similar to mounting bracket 60. Light source 90 is visible through rear portion 48 of housing member 40.

Referring generally to FIGS. 1–3, housing member 40 is mounted near the muzzle end 20 of firearm 16 on the top side of barrel 12, and housing member 40 is disposed in a position substantially parallel to barrel 12. Thus, a shooter can see light source 90 in housing member 40 along line 30 through rear portion 48 of housing member 40 when his aiming eye is aligned with barrel 12. Front portion 44 of housing member 40 is substantially closed to prevent entry of light.

Housing member 40 of sighting device 10 must have a length and diameter sufficient to prevent the shooter's non-aiming eye from making visual contact with light source 90. In addition, the diameter of housing member 40 is sufficiently narrow to ensure that the shooter's aiming eye can see light source 90 only when his aiming eye is aligned with barrel 12. Preferably housing member 40 has an outside diameter of no more than about 0.25 inches, because larger diameter tubes make firearm 16 difficult to aim and interferes with the shooter's view of the target. More preferably, housing member 40 has an outside diameter of about 0.10 inches to about 0.15 inches. Housing member 40 should be constructed with an inside diameter about 0.02 inches narrower that the outside diameter. In addition, housing member 40 is preferably from 4 to 8 inches long, and more preferably about 6 inches long. Housing member 40 can be constructed of any suitable lightweight material including cardboard, plastic or metal.

The length and inside diameter of housing member 40 are dependent on each other since the housing member 40 must be made longer as the diameter is increased to prevent the shooter's non-aiming eye from seeing light source 90 and to prevent the shooter's aiming eye from seeing light source 90 unless it is aligned with barrel 12. The length of housing member 40 is determined by the distance required from rear portion 48 to light source 90 to prevent the shooter's non-aiming eye from seeing light source 90. The minimum distance from rear portion 48 of housing member 40 to light source 90 can be calculated by the following formula:

$$L=(D\times dia)/w,$$

Where:

L is the minimum length between rear portion 48 and light source 90;

D is the distance from the shooter's aiming eye to light source 90;

dia is the diameter of housing member 40; and w is the width between the shooter's pupils along a path substantially perpendicular to line 30.

Because the light source should be positioned near the muzzle end 20 of firearm 16, the distance from the shooter's aiming eye to light source 90 is about 4 to 8 inches less than the length firearm 16. Even with longer than average firearms, the distance between the aiming eye and light source 90 should not be greater than about 35 inches. Housing member 40 should have a small outside diameter of about 0.125 inches to avoid blocking the shooter's view of the target, and a small diameter to ensure the shooter's aiming eye is aligned with barrel 12. Thus, a typical inside diameter of housing member 40 is about 0.105 inches. Finally, most shooters have at least 1.0 inches between the pupils of their eyes when their head is in the aiming position. Thus, a housing member having a length of about 3.5 inches between the rear portion 48 and light source 90 is sufficient in most cases to prevent visual contact of light source 90 by the shooter's non-aiming eye. The preferred length of about 6 inches for housing member 40 is sufficient to allow power source 94 and switch 50 to be enclosed in housing 40 as shown in FIG. 2.

Mounting brackets 60 and 64 removably attach sighting device 10 to barrel 12 of firearm 16. The number and configuration of mounting brackets is not critical to the present invention; however, sighting device 10 must be securely attached to barrel 12 to withstand the forces that occur when the firearm is discharged. In addition, brackets 60 and 64 maintain the position of housing member 40 on top of barrel 12 and coaxially disposed along line 30. Mounting brackets 60 and 64 can adapt to various barrel configurations, such as double barrels, vented-ribbed barrels, and the like to secure housing member 40 near muzzle end 20 of firearm 16. Preferably mounting brackets 60 and 64 can be easily loosened by the shooter for removal of sighting device 10 from firearm 16.

Light source 90 provides a visual stimulus that a shooter can focus on with his aiming eye, so the shooter will not use his non-aiming eye to align sighting device 10 with the target. Light source 90 does not produce enough light to illuminate a target, nor should it illuminate the shooter. Preferably light source 90 is a liquid crystal display (LCD) or a light emitting diode (LED). In addition, if light source 90 is smaller than the inside diameter of housing member 40, light source 90 is preferably centrally disposed along line 30. Alternatively, a diffusing filter could be position between light source 90 and rear portion 48 of housing member 40 that can diffuse the light, so that the light source would appear to fill the inside diameter of housing member 40. Also, a partition could be placed within the housing member with an aperture disposed on line 30 to provide a pinpoint light spot even if light source 90 is not disposed on line 30. The light filter and partition, if used at all, would have to be a minimum distance from rear portion 48 as calculated above. Polarizing filter 98 may be required to prevent light reflections off of inner wall 80 because such reflections may be seen by the shooter's non-aiming eye or may cause inaccurate aiming. Alternatively, inner wall 80 can be coated with a non-reflective material. Light source 90 can be any color desired by the shooter, but preferably a color is used that can be distinguished from the target and background.

Power source 94 is electrically coupled to light source 90 with switch 50 electrically disposed there between. Preferably, power source 94 is a standard battery known in the art, and power source 94 is disposed within housing member 40 between light source 90 and front portion 44. However, power source 94 could be mounted below barrel 12 on one of the mounting brackets or in a separate housing member. Switch 50 can be any conventional switch known in the art, including a switch activated simply by raising muzzle end 20 of firearm 16. Preferably, switch 50 is a simple pressure sensitive toggle switch that can be conveniently depressed by the shooter to alternatively energize and de-energize light source 90. Switch 50 is preferably mounted on housing member 40, and more preferably on front portion 44. However, switch 50, like power source 94, can be mounted separate from housing member 40. For example, and switch 50 could be mounted below barrel 12 on one of the mounting brackets, or alternatively, switch 50 and power source 94 could be carded by the shooter. Finally, switch 50 could be adapted to adjust the illumination of light source 90.

Sighting device 10 eliminates dominant eye cross-over problems in aiming a firearm because the non-aiming eye cannot make visual contact with light source 90. Even though the non-aiming eye can see muzzle end portion 20 of barrel 12, the visual stimulus provided by light source 90 as seen by the shooter's aiming eye is sufficient to overcome the shooter's tendency to aim with his dominant eye. Moreover, the shooter's non-aiming eye remains unobstructed, so the shooter can use both of his eyes to locate a target and to judge its speed and distance.

Sighting device 10 also ensures that the shooter's aiming eye is properly aligned with barrel 12 because housing member 40 has a narrow diameter, so light source 90 cannot be seen by the shooter's aiming unless the firearm has been properly shouldered. Although novice shooters and those shooters that are shouldering a firearm oppositely from their dominant eye are more likely to improperly shoulder a firearm, all shooters are prone to improperly shouldering a firearm. The problem is most common when the shooter must quickly shoulder a firearm to aim at fast moving targets. Thus, sighting device 10 can be used as a training device to teach proper shoulder placement of firearm 16. Once the shooter has learned how to properly shoulder a firearm, he can continue to use sighting device 10 to prevent dominant eye crossover, or he can remove it from his firearm.

When firearm 16 is properly shouldered, light source 90 essentially acts as an illuminated sighting bead located near muzzle end 20 of firearm 16 that can only be seen with the shooter's aiming eye. Housing member 40 is not much larger than sighting bead 28, so the shooter's view of the target is not obstructed. Moreover, sighting device 10 is lightweight, so firearm 16 can be easily maneuvered. Finally, sighting device 10 allows a shooter to properly aim in poor lighting conditions because of light source 90.

Sighting device 10 can be constructed in many configurations without exceeding the scope of the present invention. Sighting device 10 can be designed for use on particular models of firearms or for general use on all firearms. In addition, sighting device 10 can be constructed of durable material to withstand years of rugged use, or it can be made of disposable materials intended to be discarded after a few days of use.

Although preferred embodiments of the invention have been described in the foregoing detailed description and illustrated in the accompanying drawings, it will be understood that the invention is not limited to the embodiments disclosed but is capable of numerous rearrangements, modifications and substitutions of parts or elements without departing from the spirit of the invention. Accordingly, the present invention is intended to encompass such rearrangements, modifications and substitutions of parts or elements as fall within the scope of the invention.

I claim:

1. A sighting device for use on a firearm having a barrel and further having a muzzle end portion and an oppositely disposed butt end portion, the sighting device allowing a shooter to use one eye to aim the firearm at a target while his second eye is open, the sighting device comprising:

an elongated housing member having oppositely disposed first and second end portions, the first end portion defining an opening into the housing member, said housing member having a substantially tubular shape and further having an outside diameter of no more than about 0.25 inches;

a light source disposed within said housing member near the second end portion whereby the light source is visible through the opening on the first end portion;

a power means coupled to the light source;

a means for mounting said housing member on the barrel of the firearm with said first end portion of said housing member disposed toward said butt end portion of the firearm and said second end portion of said housing member disposed toward said muzzle end portion of the firearm; and said housing member having a length sufficient to prevent visual contact of the light source by the shooter's second eye when the shooter is aiming the firearm at a target.

2. The sighting device of claim 1, wherein said housing member has a substantially tubular shape.

3. The sighting device of claim 1, wherein said second end portion of said housing member is substantially closed.

4. The sighting device of claim 1, wherein said power means is disposed in said housing member between said light source mid said second end portion of said elongated housing.

5. The sighting device of claim 1, further comprising a switch means coupled between said light source and said power means.

6. The sighting device of claim 1, wherein said housing member has a length of from 4 to 8 inches.

7. The sighting device of claim 1, wherein said housing member is constructed of aluminum.

8. The sighting device of claim 1, wherein said housing member is constructed of cardboard.

9. The sighting device of claim 1, wherein said light source is a light emitting diode.

10. The sighting device of claim 1, wherein said light source is a liquid crystal display.

11. The sighting device of claim 1, wherein said power means is a battery.

12. The sighting device of claim 1, further comprising:

a switch means coupled between said light source and said power means, said switch means mounted on said housing member; and said power source is a battery disposed in said housing member between said light source and said second end portion of said elongated housing.

13. The sighting device of claim 1, wherein:

said housing member has an outside diameter of between about 0.1 inches and about 0.15 inches and further having said inside diameter of no more than about 0.13 inches; and said light source is at least about 3.5 inches from the first end portion of the elongated housing.

14. A sighting device for use on a firearm having a barrel and further having a muzzle end portion and an oppositely disposed butt end portion, the sighting device allowing a shooter to use one eye to aim the firearm at a target while his second eye is open, the sighting device comprising:

an elongated housing member having oppositely disposed first and second end portions, the first end portion defining an opening into said housing member;

a light source disposed within said housing member near the second end portion whereby the light source is visible through the opening on the first end portion;

a power means coupled to the light source;

a polarizing filter disposed in said housing member between said light source and the opened first end portion;

a means for mounting said housing member on the barrel of the firearm with said first end portion of said housing member disposed toward said butt end portion of the firearm and said second end portion of said housing member disposed toward said muzzle end portion of the firearm; and said housing member having a length sufficient to prevent visual contact of the light source by the shooter's second eye when the shooter is aiming the firearm at a target.

* * * * *